United States Patent [19]

Nilsen

[11] Patent Number: 4,688,584

[45] Date of Patent: Aug. 25, 1987

[54] HAIRPIECE BASE AND METHOD OF MANUFACTURE AND FITTING OF HAIRPIECE

[76] Inventor: Kare A. Nilsen, Ruselokkeveien 26,, Vikatorget, Oslo 2, Norway

[21] Appl. No.: 829,117

[22] Filed: Feb. 14, 1986

[51] Int. Cl.[4] ..... A41G 5/00

[52] U.S. Cl. ..... 132/56; 132/53

[58] Field of Search ..... 132/5, 53, 54, 56

[56] References Cited

U.S. PATENT DOCUMENTS

| | | | |
|---|---|---|---|
| 2,907,334 | 10/1959 | LeMole | 132/53 |
| 3,037,261 | 6/1962 | Hess | 132/53 |
| 3,421,521 | 1/1969 | Rich, Jr. | 132/53 |
| 3,472,246 | 10/1969 | Ostrom | 132/53 |
| 3,483,875 | 12/1969 | Trissell | 132/53 |
| 3,626,954 | 12/1971 | Ostrom | 132/5 |
| 4,422,230 | 12/1983 | Nemoto | 132/54 |
| 4,625,739 | 12/1986 | Hamazaki | 132/54 |

*Primary Examiner*—Gene Mancene
*Assistant Examiner*—Cary E. Stone
*Attorney, Agent, or Firm*—Kenneth H. Johnson

[57] ABSTRACT

A method of making a hairpiece base by which the hairpiece is fitted so as to promote the formation of a vacuum between the base of the hairpiece and the scalp of the wearer. The base is contoured and formed about its periphery so that the base is slightly smaller around its periphery than the corresponding portion of the wearer's scalp. This reduction in size creates a slight compressive force upon the wearer's scalp which aids in establishing a vacuum. The vacuum formed by expelling the air from under the base effectively seals the covered portion of the scalp to the base causing the hairpiece to adhere to the wearer, eliminating the need for adhesives.

11 Claims, 3 Drawing Figures

HAIRPIECE BASE AND METHOD OF MANUFACTURE AND FITTING OF HAIRPIECE

BACKGROUND OF THE INVENTION

The present invention relates generally to hairpieces, and more specifically relates to the method of manufacture and a method of fitting hairpieces.

The fitting of hairpieces is a personal and sensitive matter. It is imperative to maintain wearer satisfaction that when worn, the hairpiece stay securely fastened to the wearer's head. Typically, hairpieces have been attached to the wearer's head by means of some type of adhesive. Often these adhesives have taken the form of a double-sided tape or a paste. The application of these adhesives is an inconvenience and may be uncomfortable. Further, the bond created by these conventional hairpiece adhesives may be incomplete, and may allow the wig to come loose or detached. The likelihood of this happening is multiplied when the wearer is engaged in any type of physical activity. Moreover, the adhesives must be cleaned from the scalp and hairpiece shell, since they are normally suitable for only one use.

Accordingly, the present invention provides a new method of fitting hairpieces such that they fit on a wearer's head with improved security and achieve this fit without the use of adhesives.

SUMMARY OF THE INVENTION

Briefly, the present invention revolves about the method of making the hairpeice base. This process comprises the steps of (1) preparing a model of a wearer's head, for example, by preparing a mold and preparing a positive plaster cast from the mold; (2) marking the periphery of the area to be covered by the base, generally this mark will correspond to the hairline of the wearer; (3) making a recess in the model along said mark, for example, by a groove or cut to a predetermined depth; (4) tapering the model from bottom of said recess toward the center of the area to be covered by said base to the original contours of said model; and (5) casting a non-porous, semi-rigid, synthetic resin (preferably clear) over the area of said model bound by said groove or cut and within said groove or cut boundary to form a film, for example, by casting liquid or flowable resin thereover and using a negative mold to press the resin to the model and allowing the resin to harden, or a sheet of suitable material may be applied between the positive and negative portions with the application of heat and pressure to mold the sheet to the model thereby forming the base. It is also desirable after the base is formed in this fashion to remove a small portion of the base adjacent to the edge thereof, formed by the casting by cutting around the periphery of the base with a knife or other sharp cutting instrument to remove the cast edge. It has been found that removing the portion of the base adjacent to the edge removes casting imperfections and obtains a better vacuum seal on the skin of the wearer's head. The cut must be made within the portion of the base formed over the tapered section of the model such that the advantages described hereafter are obtained.

In accordance with the present invention, a hairpiece is fitted so as to promote the creation of a vacuum between the underside of the base of the hairpiece, or base, and the scalp of the wearer. Once created, this vacuum serves to adhere the hairpiece to the wearer without the need for additional ahesives. Additionally, any natural oils or perspiration released through the scalp of the wearer will not cause deterioration of the fit, but will serve to promote the vacuum effect.

The vacuum used to hold the hairpiece firmly to the wearer's head is created by shaping the hairpiece base so that it fits tightly on top of the wearer's head. Broadly speaking, the invention in one aspect concerns a method of modifying the periphery of the hairpiece base. The periphery of the base is conformed so that it contacts the scalp of the wearer and creates a bond between the base and the scalp. More particularly, the peripheral portion of the base is made somewhat smaller than the portion of the wearer's scalp against which the base will fit. Additionally, the curvature of the base near the periphery is more pronounced than the curvature of the portion of the scalp engaged by the base.

As a result of the conformity described above, the peripheral portion of the base is displaced slightly when the hairpiece is placed on the wearer's scalp. This slight distortion or displacement causes the base to exert a slight compressive force on the scalp. This force, which extend around the scalp, effectively seals the covered portion of the scalp from the atmosphere, and estaablishes a vacuum between the wearer's scalp and the base. This vacuum secures the hairpiece to the wearer's scalp and enables the hairpiece to resist forces such as wind or movement which would otherwise tend to dislodge or remove the hairpiece.

DETAILED DESCRIPTION OF A PREFERRED EMBODIMENT

One preferred embodiment of fitting hairpieces according to the present invention involves the fitting of hairpieces having a semi-rigid and non-porous base, or shell, which is conformed to fit closely against the wearer's scalp and which has the hair portions of the hairpiece attached thereto. The hair can be attached to the base either directly, or may be coupled to a piece of plastic which is then itself secured to the base. The attachment of the hair to the base may be achieved by any of the known methods, however, that described in U.S. Pat. No. 3,589,376 which is incorporated herein is preferred.

Figure 1:
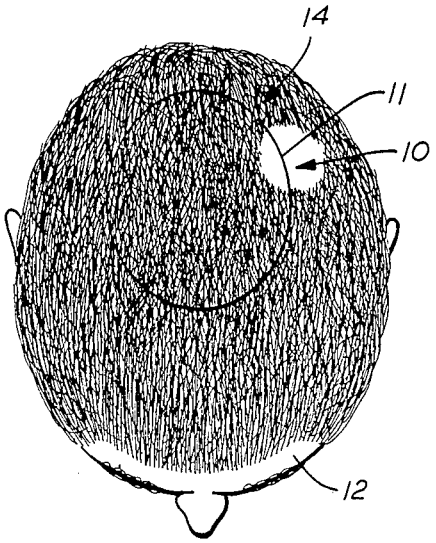
FIG. 1 is a top view of the hairpiece resting on the head of a wearer.

Referring now to the drawings in more detail, and particularly FIG. 1, therein is illustrated a hairpiece 10 including a base 11 fitted upon the head of a wearer, illustrated generally at 12. A surface covering, in this a number of "hairs" are illustrated generally at 14. Those skilled in the art will recognize that hairs 14 may be any of a variety of materials including both synthetic materials and natural hair.

The conventional method of fitting many hairpieces consists of first making an accurate plaster model of a person's head. The periphery of the area of the scalp to be covered by the hairpiece is then marked out on the model. Next, a base made of a suitable synthetic resin is placed on the model and is cut to match the area outlined on the model. The base is then heated or otherwise treated to mold itself accurately to the model of the person's scalp.

A preferred method of practicing the present invention modifies the above procedure. As with the previously known methods, a plaster model is made of the wearer's head, and the initial boundary of the base of the hairpiece is marked on the model.

Figure 2B:
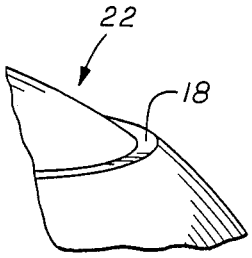
FIGS. 2A–2B depict a mold of wearer's head modified in accordance with the present invention.
Figure 2A:
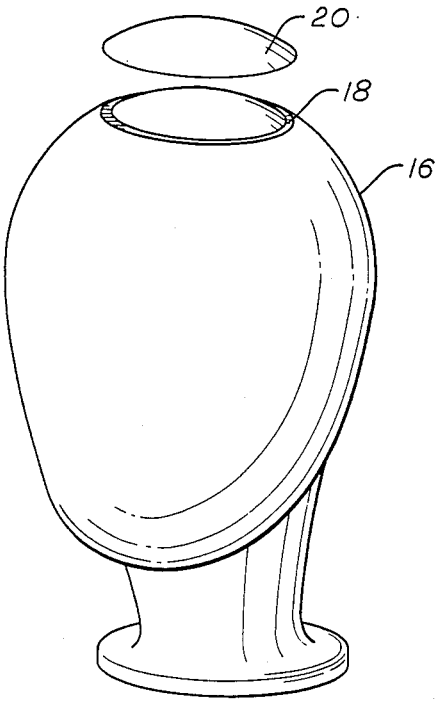

Referring now also to FIGS. 2A–B, therein is shown a model 16 of a wearer's head (positive mold) which has been modified. The model 16 is modified by reducing an area on the model 16 that corresponds to the area on the wearer's scalp on which the periphery of the base will fit. This is conveniently done by forming a recess (groove or cut) 18 in the surface of the model 16 immediately adjacent to and inside the periphery of the area upon which the base 11 will fit. It is important to recess the appropriate portions of the model 16 so that the base will fit upon the wearer's head comfortably, while also being able to produce the required compressive force. The applicant has found that a recess 18 at the periphery of the area covered by the base 11 of approximately 1–5 millimeters will typically provide a satisfactory fitting base. The inner depth of this recess 18 will then be tapered into the original curvature of the model 16. This taper is preferably accomplished over a distance 22 of approximately ½ to 4 centimeters from the edge of the recess 18. The depth of the recess 18 may be varied in response to the wearer's scalp. When the skin on the wearer's scalp is relatively thick or tight, it has been found desirable to make recess deeper so as to increase the compressive force exerted against the scalp. The depth of the recess 18 may be advantageously varied around the periphery of the model 16 in response to such scalp conditions.

The model 16 may be recessed in any appropriate manner. One technique is to first mark the area on the model 16 to be adjacent the periphery of the base 11. A square-bladed knife may then be pushed directly into the model in a generally horizontal plane. The knife is pushed into the model only to the desired depth of the recess 18. As discussed above, this depth may vary around the periphery. Once the depth of the recess has been cut in this manner around the model 16, the outer surface of the model 16 may be shaved down until the shaved area meets the inner edge of the circumscribing cut. The shaved area of the model 16 can then be smoothed and graduated as appropriate.

Once the model 16 is modified so that the area of the model 16 corresponding to the periphery of the base is slightly smaller than the wearer's head, synthetic resin is placed upon the model 16 and heated or otherwise treated until it becomes semi-rigid. Generally a negative mold 20 is used with pressure and heat to form the synthetic resin to the curvature and conformation (i.e., the topography) of the model and hence the wearer's head. The result is a non-porous, semi-rigid base with a periphery which is slightly smaller than the portion of the wearer's head against which the periphery will fit. In the preferred process a portion of the base is cut away around the periphery just back from the cast edge, e.g., up to one-half of the taper thereby removing imperfections found to form along the edge of the base in casting. The cut should correspond to the hairline of the wearer. In such case the recess is made at a point slightly below the hairline. As the base is pushed against the wearer's scalp, the scalp is compressed. Simultaneously, the periphery of the base widens slightly to exert compressive force against the wearer's scalp. The pressing of the base against the scalp forces the air between the base and scalp outside the confines of the base, establishing a vacuum. The vacuum is enhanced by the previously described molding of the base to the exact shape of the wearer's head, except for the smaller periphery of the base. Once the pressure on the base is released, the relaxing of the stretched skin and of the widened base establishes the space between the base and the wearer's scalp, establishing the vacuum. The mechanical pressure of the periphery of the base against the scalp maintains the atmospheric seal around the periphery of the base.

Once the base 11 has been made, it should be checked for fit on the wearer's head. The base 11 will be placed on the wearer's head and then pushed down to secure the engagement with the scalp. If the base 11 is properly fitted, it should be difficult to remove the base from the wearer's scalp. If the base 11 can be easily removed, it will typically be desirable to remove additional area from the model 16 so as to further increase the curvature of base 11 albeit ever so slightly.

When the base has been determined to be properly fitted, the portion of the hairpiece supporting the hair is attached to the top side of the base, and the hairpiece is ready for use by the wearer.

Many changes and variations may be made in the techniques described and illustrated herein without departing from the spirit and scope of the present invention. Accordingly, the embodiments of the invention described and illustrated herein are illustrative only and are not be be considered as a limitations on the scope of the present invention.

The invention claimed is:

1. The method of forming a base for use in making a hairpiece comprising:

(a) preparing a model of a wearer's head;

(b) marking on the model the periphery of the area to be covered by the base;

(c) making a recess in said model along said marking to a predetermined depth;

(d) tapering the model from the bottom of said recess toward the center of the area to be covered by said base to the original contours of said model;

(e) casing a non-porous, semi-rigid synthetic resin over the area of said model bound by said recess thereby forming a base corresponding to fit the conformation of a portion of the wearer's head over the major portion thereof and being slightly smaller than the wearer's head about the periphery thereof.

2. The method according to claim 1 wherein said base is cut about the periphery within the area corresponding to the tapered portion to remove a portion of said base.

3. The method according to claim 2 wherein said model is a positive mold case from a mold of the wearer's head.

4. The method according to claim 3 wherein a negative mold made from the wearer's head is employed cooperatively with said positive mold to form said base.

5. The hairpiece base manufactured by the process of claim 4.

6. The hairpiece base manufactured by the process of claim 3.

7. The hairpiece base manufactured by the process of claim 2.

8. The method according to claim 1 wherein said recess is about 1 to 5 mm.

9. The method according to claim 8 wherein the tapering is from ½ to 4 cm.

10. The hairpiece base manufactured by the process of claim 1.

11. The hairpiece base according to claim 10 having hair affixed thereto.

* * * * *